US005775189A

United States Patent [19]

Ikoma et al.

[11] Patent Number: 5,775,189

[45] Date of Patent: Jul. 7, 1998

[54] CUTTING MACHINE

[75] Inventors: Kenji Ikoma, Wakayama; Reiji Arikita, Naga-gun, both of Japan

[73] Assignee: Shima Seiki Manufacturing Limited, Wakayama, Japan

[21] Appl. No.: 727,121

[22] Filed: Oct. 8, 1996

[30] Foreign Application Priority Data

Oct. 9, 1995 [JP] Japan ..... 7-261899

[51] Int. Cl.[6] ..... B26D 3/14

[52] U.S. Cl. ..... 83/76.1; 83/668; 83/917; 83/174.1

[58] Field of Search ..... 83/174, 174.1, 83/862, 49, 917, 936, 668, 683, 76.1, 76.6, 76.9

[56] References Cited

U.S. PATENT DOCUMENTS

| | | | |
|---|---|---|---|
| 3,766,813 | 10/1973 | Pearl | 83/917 |
| 4,048,891 | 9/1977 | Pearl | 83/936 |
| 4,364,330 | 12/1982 | Pearl | 118/697 |
| 4,401,001 | 8/1983 | Gerber et al. | 83/451 |
| 4,462,292 | 7/1984 | Pearl | 83/471.2 |
| 4,643,061 | 2/1987 | Gerber | 83/174.1 |
| 4,667,553 | 5/1987 | Gerber et al. | 83/917 |
| 4,685,363 | 8/1987 | Gerber | 83/22 |
| 4,709,483 | 12/1987 | Hembree et al. | 33/18.1 |
| 4,725,961 | 2/1988 | Pearl | 364/475 |
| 5,040,442 | 8/1991 | Nasu | 83/422 |
| 5,042,339 | 8/1991 | Gerber | 83/49 |
| 5,044,238 | 9/1991 | Etcheparre et al. | 83/49 |
| 5,134,911 | 8/1992 | Busky et al. | 83/49 |
| 5,216,614 | 6/1993 | Kuchta et al. | 83/49 |

FOREIGN PATENT DOCUMENTS

| | | | |
|---|---|---|---|
| 7246594 | 9/1995 | Japan | B26D 5/00 |
| 2 175 828 | 12/1986 | United Kingdom | B26D 7/12 |
| 2175828 | 12/1986 | United Kingdom | B26D 7/12 |

OTHER PUBLICATIONS

Nov. 11, 1997 letter from Japanese associate.

Nov. 3, 1997 letter from European Patent Office.

Mar. 24, 1997 letter from European Associate reporting the European patent search.

Search Report from european Patent Office dated May 3, 1997.

One page identified as Translation of Japanese Unexamined Patent Publication(A).

*Primary Examiner*—Maurina T. Rachuba

*Attorney, Agent, or Firm*—Baker & Botts, L.L.P.

[57] ABSTRACT

A cutting head is provided also with a notching blade to enable it to cut a length shorter than the blade width of a round blade. In order to eliminate the need for compressed air supplying equipment and simplify the mechanism thereby to make it compact and light weight, an angular displacement servo motor is used as a common drive source for causing angular displacement of the round blade and angular displacement of the notching blade. A cam motor causes a round blade cam and a notching blade cam to make angular displacement thereby to selectively cause the round blade and the notching blade to work on sheet material placed on a cutting table an cut it.

9 Claims, 14 Drawing Sheets

CUTTING MACHINE

BACKGROUND OF THE INVENTION

1. Field of the Invention

The present invention relates to a cutting machine for cutting sheet material such as woven fabric according to cutting data, particularly to a cutting machine which employs a round blade.

2. Description of the Related Art

There is known a prior art cutting machine for cutting sheet material of such a cutting method that a round blade is driven to rotate and cut the sheet material. A typical prior art cutting machine is disclosed, for example, in U.S. Pat. No. 4,462,292. In this prior art, in addition to a round blade which cuts sheet material placed on a hard surface along a cutting line indicated by cutting data while making contact with the sheet material in a near point contact condition, a notching blade for making a notch in the sheet at right angles to the cutting line is provided on a cutting head. By cutting the sheet material with the round blade, configuration of the cutting head can be simplified and reduced in size and weight compared to a type of cutting with a straight reciprocating blade. Cutting speed is also increased, but it is not possible to cut a stack of many sheets. Therefore, a cutting machine having a round blade is suited to test manufacture or small-volume production rather than mass production.

Prior art having a straight blade for cutting sheet material through reciprocating motion mounted on a cutting head as the cutting blade is disclosed, for example, in U.S. Pat. No. 5,044,238. In this prior art, a drilling tool for perforation is provided which is driven to rotate by means of rotation driving force used in changing the cutting blade orientation. Also disclosed in Japanese Unexamined Patent 7-246594 (1995) is prior art which drives two cutting blades having different blade widths separately to move in vertical direction while angular displacements thereof are driven commonly.

In prior art disclosed in U.S. Pat. No. 4,462,292, a round blade and a notching blade are linked via a compression spring, while a state of cutting with the round blade only and a state of cutting with the round blade and the notching blade are switched by the pressing force of a pneumatic cylinder. Therefore, the notching blade cannot be used independently. Also because the pneumatic cylinder is used to press the round blade and the notching blade against the sheet material, equipment for supplying compressed air such as an air compressor is required, making it difficult to install the cutting machine near storefront.

In the prior art of U.S. Pat. No. 5,044,238, the drilling tool for perforation is driven to rotate by means of rotation driving force used in changing the orientation of the cutting blade thereby to simplify the cutting head. However, such a mechanism is necessary that causes the straight blade to move reciprocatingly and turn around a rotation axis which is perpendicular to the cutting table surface, making it unavoidable that the configuration becomes more complicated than the case of using a rotary blade. Also because compressed air is used to move up and down the cutting blade and the perforating tool at right angles to the cutting table surface, there is such a restriction as described above with respect to the place to install the cutting machine.

In the prior art disclosed in Japanese Unexamined Patent Publication 7-246594 (1995), angular displacement of two blades are driven commonly but the vertical movements are driven separately, and therefore separate drive sources are required. Because the main cutting blade cuts the sheet material by utilizing the contact angle, it is not capable of cutting at a high speed as a rotary blade or a reciprocating blade.

SUMMARY OF THE INVENTION

An object of this invention is to provide a cutting machine whose cutting head can be made small and lightweight by simplifying the mechanism of the cutting head which comprises a round blade and another type of blade or a drilling tool, and in which it is necessary to use piping installations for supplying compressed air.

The invention provides a cutting machine which has a cutting table; a round blade for cutting a sheet material spread on a surface of the cutting table with a circumferential cutting edge thereof, the round blade having a rotation shaft parallel to the surface of the cutting table; and a cutting head for cutting the sheet material, while moving in parallel with the surface of the cutting table according to cutting data, the cutting head having a notching blade for cutting the sheet material by pressing an edge thereof against an surface of the sheet material, the cutting machine comprising:

selecting means for selectively displacing either the round blade or the notching blade in a direction of approaching or departing from the cutting table by driving force from a common drive source, and thereby selectively applying either the round blade or the notching blade to the sheet material to cut it;

an angular displacement motor for driving the round blade and the notching blade so that a cutting direction is changed by angular displacement about an angular displacement axis thereof perpendicular to the surface of the cutting table;

transmitting means for transmitting driving force from the angular displacement motor to angular displacement shafts of the round blade and the notching blade in a predetermined proportion; and control means for controlling the angular displacement motor so that the cutting direction of the round blade or the notching blade changes according to the cutting data.

According to the invention, driving force from the angular displacement motor can be transmitted in a predetermined proportion by means of the transmitting means under control of the control means and commonly used for changing of orientations of both the round cutting blade and of the notching blade. Because a common drive source of the selecting means is used for applying either the round blade or the notching blade to the sheet material, the mechanism of the cutting head can be simplified and reduced in size and weight.

The invention is characterized in that the transmitting means has driven gears mounted on the respective angular displacement shafts and a drive gear which is mounted on a rotation shaft of the angular displacement motor and is meshed with the respective driven gears, and at least either of the drive gear and the driven gears have a thickness in the axial line direction so that the gears can be kept in mesh even when the driven gears are displaced in a direction of approaching or departing from the cutting table.

According to the invention, since the transmitting means transmits the driving force through the mesh of the gears, the distance between the rotation shaft of the angular displacement motor and the angular displacement axes can be made shorter than in the case of transmission by means of a belt or the like, thus making the cutting head smaller. By making at least either the drive gears or the driven gears thicker, even when the meshing position deviates in the angular displacement axis direction of the gear as a result of selection by the selecting means, the rotation driving force can be transmitted smoothly.

The invention is characterized in that the cutting head further has a perforating drill for perforating the sheet material, which has a rotation axis perpendicular to the cutting table and is driven by the driving force from the angular displacement motor to rotate, and the selecting means selects one from among the round blade, the notching blade and the perforating drill, and allows the selected one to work on the sheet material by displacement in a direction of approaching and departing from the cutting table.

According to the invention, the perforating drill is also driven by the driving force from the common angular displacement motor and is selectively made to operate to the sheet material by the selecting means, and therefore the cutting head having many functions can be formed in a simple configuration.

Further the invention provides a cutting machine which has a cutting table, a round blade having a rotation shaft parallel to a surface of the cutting table for cutting sheet material spread on the surface of the cutting table with a circumferential edge thereof, a notching blade for cutting the sheet material by pressing an edge thereof against the sheet surface and a cutting head for cutting the sheet material while moving in parallel with the surface of the cutting table according to cutting data, the cutting machine comprising:

supporting means for supporting the round blade so as to rotate about the rotation axis thereof, be angularly displaced about an angular displacement axis perpendicular to the cutting table surface and be reciprocatingly displaced along the angular displacement axis;

round blade cam means for driving the supporting means to be displaced in a direction of approaching or departing from the cutting table;

a cam motor for driving the round blade cam means;

notching blade cam means driven by the cam motor, for driving the notching blade to be displaced in a direction of departing from the cutting table when the round blade is moved by the round blade cam means beyond a predetermined amount of displacement in the direction of departing from the cutting table;

notching blade pressing means for pressing the notching blade in a direction of approaching the cutting table;

notching blade holding means for holding the notching blade in a state of being departed from the cutting table; and control means for controlling the cam motor and the notching blade holding means so that either the round blade or the notching blade works on the sheet material.

According to the invention, either the round blade or the notching blade can be selected to cut the sheet material by the round blade cam means or the notching blade cam means which are driven by the cam motor. By canceling the holding by the control means while holding the notching blade in the state of being departed from the cutting table by the notching blade holding means, the notching blade can be pressed against the sheet material surface with the notching blade pressing means forcing thereof.

The invention is characterized in that the cutting head further has:

a perforating drill for perforating the sheet material by pressing against the cutting table;

perforating drill pressing means for pressing the perforating drill in a direction of approaching the cutting table; and perforating drill holding means for holding the perforating drill in a state of being departed from the cutting table, wherein the notching blade cam means drives also the perforating drill to depart from the cutting table when the notching blade cam means drives the notching blade to be displaced in a direction of departing from the cutting table, and the control means controls the cam motor, the notching blade holding means and the perforating drill holding means so that one from among the round blade, the notching blade and the perforating drill is selected and is displaced in a direction of approaching or departing from the cutting table to work on the sheet material.

According to the invention, in addition to the round blade and the notching blade, the perforating drill can be displaced by the cam motor. The perforating drill is driven to be displaced in the direction of departing from the cutting table by the notching blade cam means and is held by the perforating dill holding means. By canceling the holding by the control means, the perforating drill can be pressed against the sheet material surface by the force of the perforating drill pressing means.

The invention is characterized by comprising balancing means for causing reverse force to act against the gravity acting on the supporting means.

According to the invention, the cam motor load can be reduced by canceling the gravity acting on the support means for supporting the round blade, by the balancing means. Since the output required for the cam motor is reduced, a smaller motor can be used, thereby further reducing the cutting head in size and weight.

Further the invention provides a cutting machine a cutting machine which has a cutting table, a round blade having a rotation shaft parallel to a surface of the cutting table for cutting sheet material spread on the surface of the cutting table with a circumferential edge thereof, a notching blade for cutting the sheet material by pressing an edge thereof against the sheet surface and a cutting head for cutting the sheet material while moving in parallel with the surface of the cutting table according to cutting data, the cutting machine comprising:

supporting means for supporting the round blade so as to rotate about the rotation axis thereof, be angularly displaced about an angular displacement axis perpendicular to the cutting table surface and be reciprocatingly displaced along the angular displacement axis;

round blade cam means for driving the supporting means to be displaced in a direction of approaching or departing from the cutting table;

a cam motor for driving the round blade cam means;

notching blade cam means driven by the cam motor, for driving the notching blade to be displaced in a direction of departing from the cutting table when the round blade is moved by the round blade cam means beyond a predetermined amount of displacement in the direction of departing from the cutting table;

notching blade pressing means for pressing the notching blade in a direction of approaching the cutting table;

notching blade holding means for holding the notching blade in a state of being departed from the cutting table;

an angular displacement motor for driving the round blade and the notching blade to be angularly displaced about the respective angular displacement axes thereof disposed perpendicular to the surface of the cutting table to change the cutting direction;

transmission means for transmitting the driving force from the angular displacement motor to the angular displacement shafts of the round blade and the notching blade in a predetermined proportion; and control means for controlling the cam motor and the notching blade holding means so that either the round blade or the notching blade works on the sheet material and for controlling the angular displacement motor to change the cutting direction of the round blade or the notching blade according to the cutting data.

According to the invention, since angular displacement for changing the orientations of the round blade and the notching blade is carried out by the driving force from the common angular displacement motor, and displacement of the round blade and the notching blade approaching or departing from the cutting table is carried out by the common cam motor, the mechanism of the cutting head can be simplified and reduced in size and weight.

According to the invention, as described above, driving force from the angular displacement motor can be commonly used in changing the orientation of the round blade and the orientation of the notching blade. Since the drive source of the selecting means for making either the round blade or the notching blade work on the sheet material is used in common, the mechanism of the cutting head can be simplified and reduced in size and weight.

Further according to the invention, since the transmission means transmits the driving force by means of gear mesh, the cutting head can be small-sized and the mechanism can be simplified in comparison with transmission by means of belt or the like.

Further according to the invention, since rotation of the perforating drill and change in orientation of the round blade and the notching blade are driven by the driving force from the common angular displacement motor and made to work selectively on the sheet material by the selecting means, the number of functions of the cutting head can be enhanced and additionally the cutting head can be made in a simple construction.

Further according to the invention, the sheet material can be cut by the round blade cam means or the notching blade cam means which are driven by the common cam motor by selecting either the round blade or the notching blade. By canceling the holding by the control means while holding the notching blade in the state of being departed from the cutting table by the notching blade holding means, the notching blade can be pressed against the sheet material surface to penetrate therethrough by the force of the notching blade pressing means. Since it is not necessary to involve the notching blade cam means in displacing the notching blade so as to approach the cutting table, the configuration can be simplified. Additionally, since compressed air is not used in the displacement of the round blade and the notching blade, installations required for operating the cutting machine can be simplified.

Further according to the invention, the perforating drill as well as the round blade and the notching blade can be displaced by a common cam motor. The perforating drill is driven by the notching blade cam means to be displaced in the direction of departing from the cutting table, and is held by the perforating drill holding means. By canceling the hold by the control means, the perforating drill is forced by the perforating drill pressing means to be pressed against the sheet material surface. Since the common driving force is used, the cutting head can be small-sized and of lighter-weight without the use of compressed air.

Further according to the invention, a load of the cam motor can be reduced by canceling the gravity acting on the supporting means which supports the round blade, by the balancing means, thereby a smaller cam motor can be used and the cutting head can be further reduced in size and weight.

Further according to the invention, since angular displacement for changing the orientation of the round blade and the notching blade is carried out by the driving force from the common angular displacement motor in accordance with the cutting data and displacement of the round blade and the notching blade approaching or departing from the cutting table for switching the round blade and the notching blade are made by the common cam motor, the mechanism of the cutting head can be simplified and reduced in size and weight. Also because these driving forces can be generated without the use of compressed air supplied by an air compressing equipment, restrictions on the place of installing the cutting machine can be reduced.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
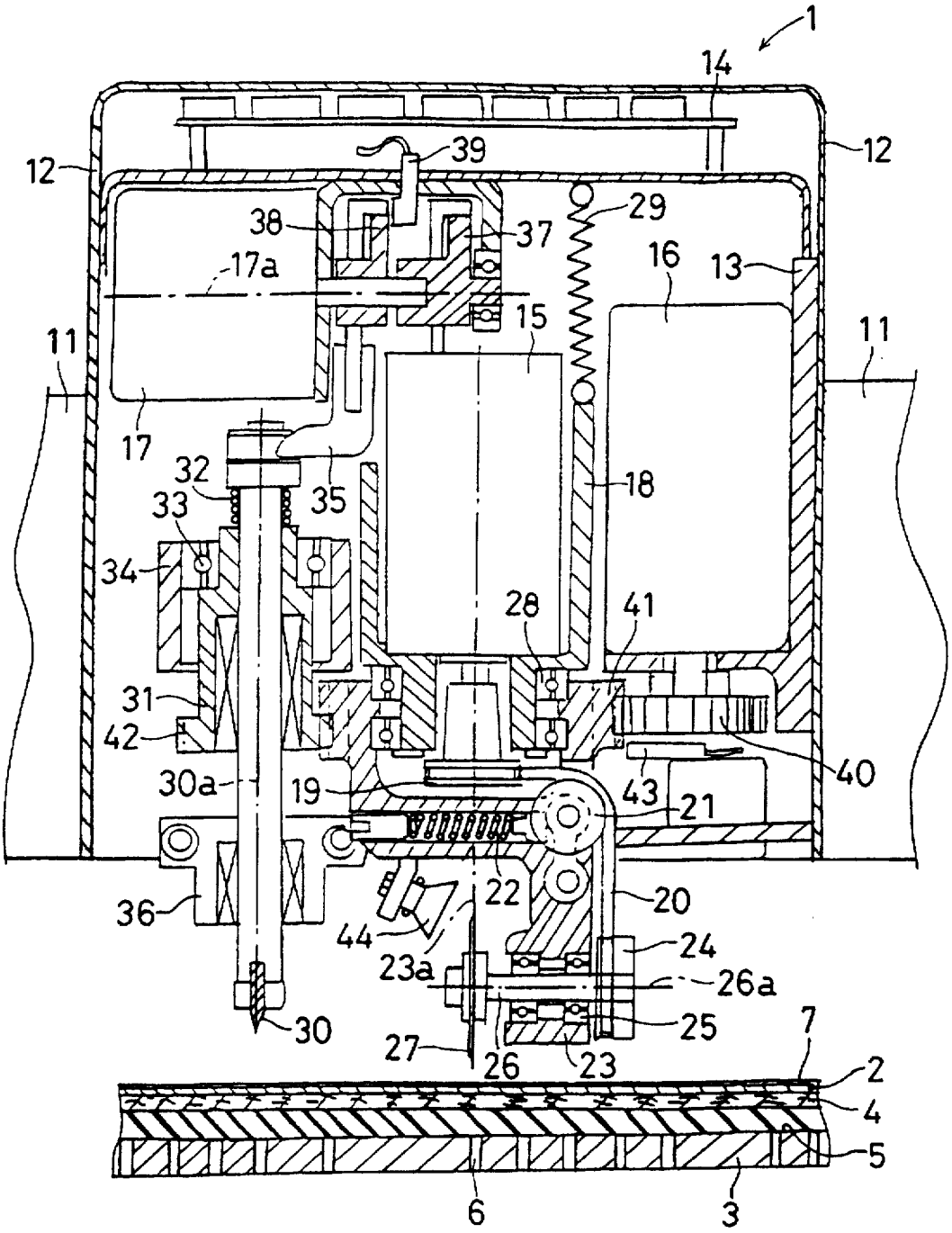
FIG. 1 is a schematic front sectional view showing the configuration of a cutting head of one embodiment of the invention.

Now referring to the drawings, preferred embodiments of the invention are described below.

FIG. 1 schematically shows the configuration of a cutting head 1 of one embodiment of the invention. A cutting head 1 cuts a sheet material 2 while moving according to cutting data over a rectangular cutting table 3 over which the sheet material 2 is spread and held by vacuum sucking or the like. Interposed between the sheet material 2 and the surface of the cutting table 3 is a base sheet 4 in case cutting in by a cutting blade is permitted. As required, the sheet material 2 may also be spread over the surface of hard cutting table 3 and cut by means of the cutting blade in a condition of near point contact. The base sheet 4 is air-permeable and is placed on an air-permeable conveyor belt 5. The cutting table 3 has a number of vent holes 6 formed in the surface thereof. A surface of the sheet material 2 is covered by an air-impermeable vinyl sheet 7 in order to reliably maintain vacuum.

The cutting head 1 is mounted on a beam 11 that moves in X-axis direction which is the direction of longer side of the cutting table 3, and can move in the longitudinal direction of the beam 11, namely Y-axis direction which is shorter side of the cutting table 3. Housed in a housing 12 of the cutting head 1 is a base 13, and a control circuit board 14 is housed above the base 13. Also housed in the housing 12 are three motors; a round blade motor 15, angular displacement servo motor 16 and a cam motor 17. The angular displacement servo motor 16 and the cam motor 17 are fixed on the base 13. The round blade motor 15 is mounted on a holder 18 which is movable in Z-axis direction perpendicular to the cutting table 3 surface, namely vertically, relative to the base 13.

Mounted at the tip of a rotation shaft extending downward from the round blade motor 15 is a drive pulley 19. Wound around the drive pulley 19 is a flat belt 20 in a plane perpendicular to the axis thereof. The flat belt 20 is changed in the direction vertically by an adjust pulley 21. The adjust pulley 21 presses the flat belt 20 with the force of an adjust spring 22 thereby to give a tension to the belt. Mounted at the bottom tip of an angular displacement member 23 whereon the adjust pulley 21 and the adjust spring 22 are mounted is a driven pulley 24 whereon the flat belt is wound. The driven pulley 24 is mounted at one end of a rotation shaft 26 which is pivotally supported by a bearing 25. Mounted on another end of the rotation shaft 26, of which axial line 26*a* is parallel to the surface of the cutting table 3, is the round blade 27 at a position on angular displacement axial line 23*a* of the angular displacement member 23, and cuts the sheet material 2 by the rotation of the rotation shaft 26. Diameter of the drive pulley 19 is greater, two times for example, than diameter of the driven pulley 24. By this configuration, when the round cutting blade motor is run at about 3000 rpm, the round blade 27 is driven to rotate at 6000 rpm. At such a revolutionary speed as this, running noise becomes excessive in case the driving force is transmitted through gear mesh. Use of the flat belt enables it to transmit the driving force quietly. Decreasing the diameter of the driven pulley 24 makes it possible to bring the round blade 27 nearer to the base sheet 4. Slippage can be prevented by increasing the width of the flat belt 20.

Interposed between the holder 18 and the angular displacement member 23 is a roller bearing 28 enabling smooth relative angular displacement. The holder 18 and the angular displacement member 23 make consolidated displacement in the Z-axis direction which is at right angles to the cutting table surface. In order to reduce the combined weight, a balancing spring 29 is installed. Instead of the balancing spring 29, such a configuration as a balance weight is suspended via a pulley may be employed. Cutting of the sheet material 2 in case the base sheet 4 is used is carried out by causing the cutting edge to cut a little into the base sheet 4. Thickness of the base sheet 4 is required to be at least twice the depth of the blade edge cutting therein. Diameter of the round blade 27 is 1 inch, for example, and cuts through a stack of sheet material 2 of a thickness about a half of the diameter. A straight section of cutting line shorter than this cutting blade width must be cut with, not the round blade 27, but the notching blade 30 of blade width within half the diameter of the round blade. When the base sheet 4 is not used, the notching blade 30 is used only for forming a notch because the round blade 27 touches the sheet material 2 with near point contact and the blade width is accordingly smaller.

Mounted on the shaft upward of the notching blade 30 is a ball spline 31 for angular displacement of the notching blade 30 around the axial line 30*a* while allowing displacement in the axial line 30*a* by means of an oil retaining bearing. Above the ball spline 31, a shaft portion of the notching blade 30 is forced downward by a notching blade spring 32. Upper portion of the ball spline 31 is supported via a bearing 33 by a holder 34 fixed on the base 13. The notching blade 30 receives lifting force transmitted via an arm 35 to the upper end thereof. Mounted downward of the shaft of the notching blade 30 is a bearing 36 provided with an oil retaining bearing which enables vertical displacement of the notching blade 30.

The cam motor 17 is constituted of a stepping motor, for example, and causes the round blade cam 37 and the notching blade cam 38 to make angular displacement about the axial line 17*a*. Reference position of each cam is detected by a cam home position sensor 39. The round blade cam 37 causes the holder 18 as supporting means of the round cutting blade 27 and the angular displacement member 23*a* to make vertical displacement along the angular displacement axial line 23*a*. The notching blade cam 38, via the arm 35, causes the notching blade 30 to make vertical displacement along the axial line 30*a*. Vertical displacement of the round blade 27 by the round blade cam 37 and vertical displacement of the notching blade 30 by the notching blade cam 38 are selected according to the direction of angular displacement of the cam motor 17. That is, when the motor makes angular displacement to one side, another side is made to wait at the top position. This cam mechanism constitutes the selecting means.

Mounted at the tip of the output shaft of the angular displacement servo motor 16 is a drive gear 40, which is in mesh with a driven gear 41 for the round blade formed in an upper portion of the angular displacement member 23. The driven gear 41 is formed to be thicker in the direction of angular displacement axial line 23*a*, and maintains meshing relation even during vertical displacement. The driven gear 41 for the round blade meshes also with a driven gear 41 for notching blade. Whether the driven gear 41 for the round blade is at the reference angular position or not is detected by an angular home position sensor 43. Mounted below the housing 12 is a grinding stone 44 which is moved by a solenoid to a working position for grinding the round blade 27.

Figure 2:
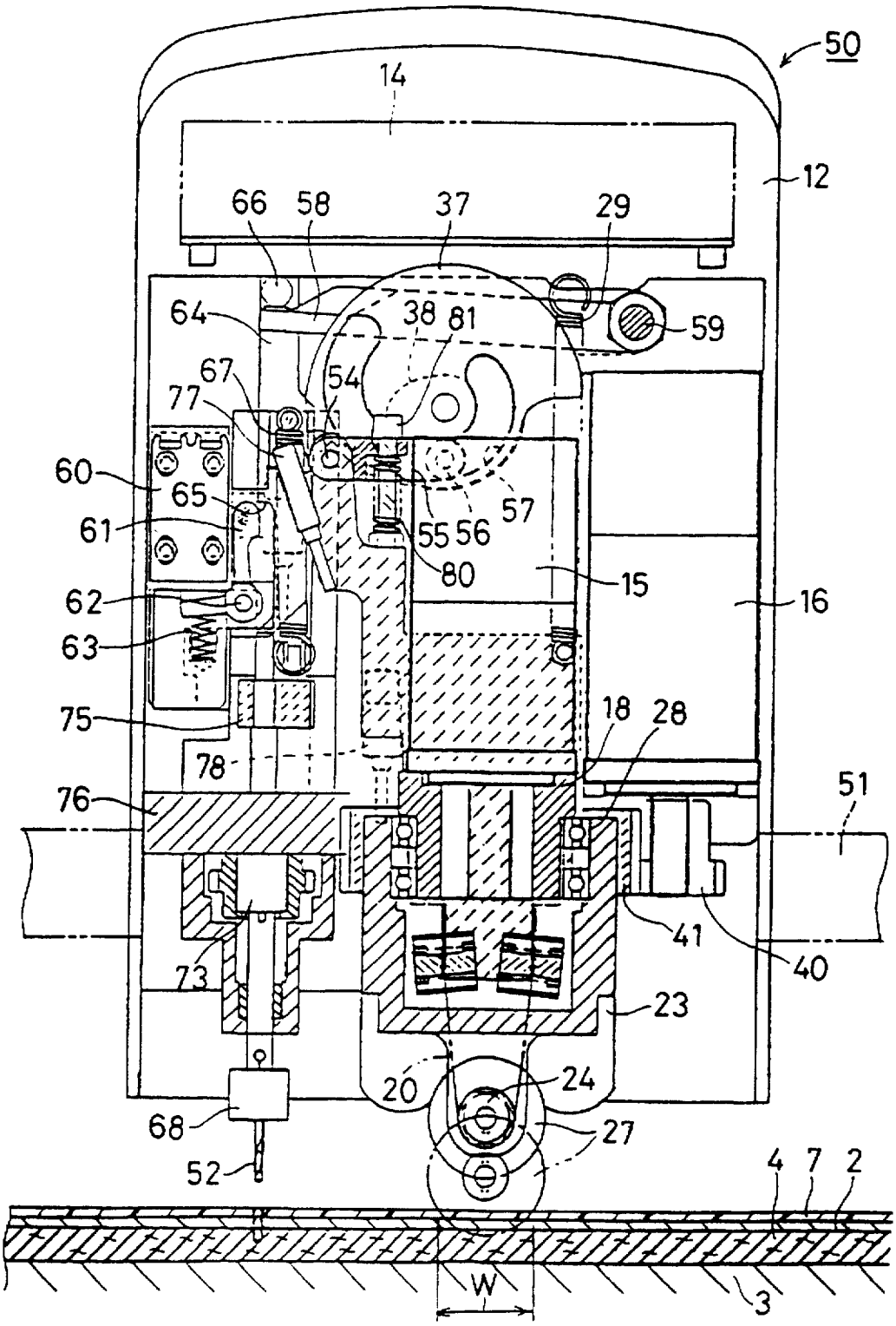
FIG. 2 is a front sectional view of a cutting head of another embodiment of the invention.
Figure 3:
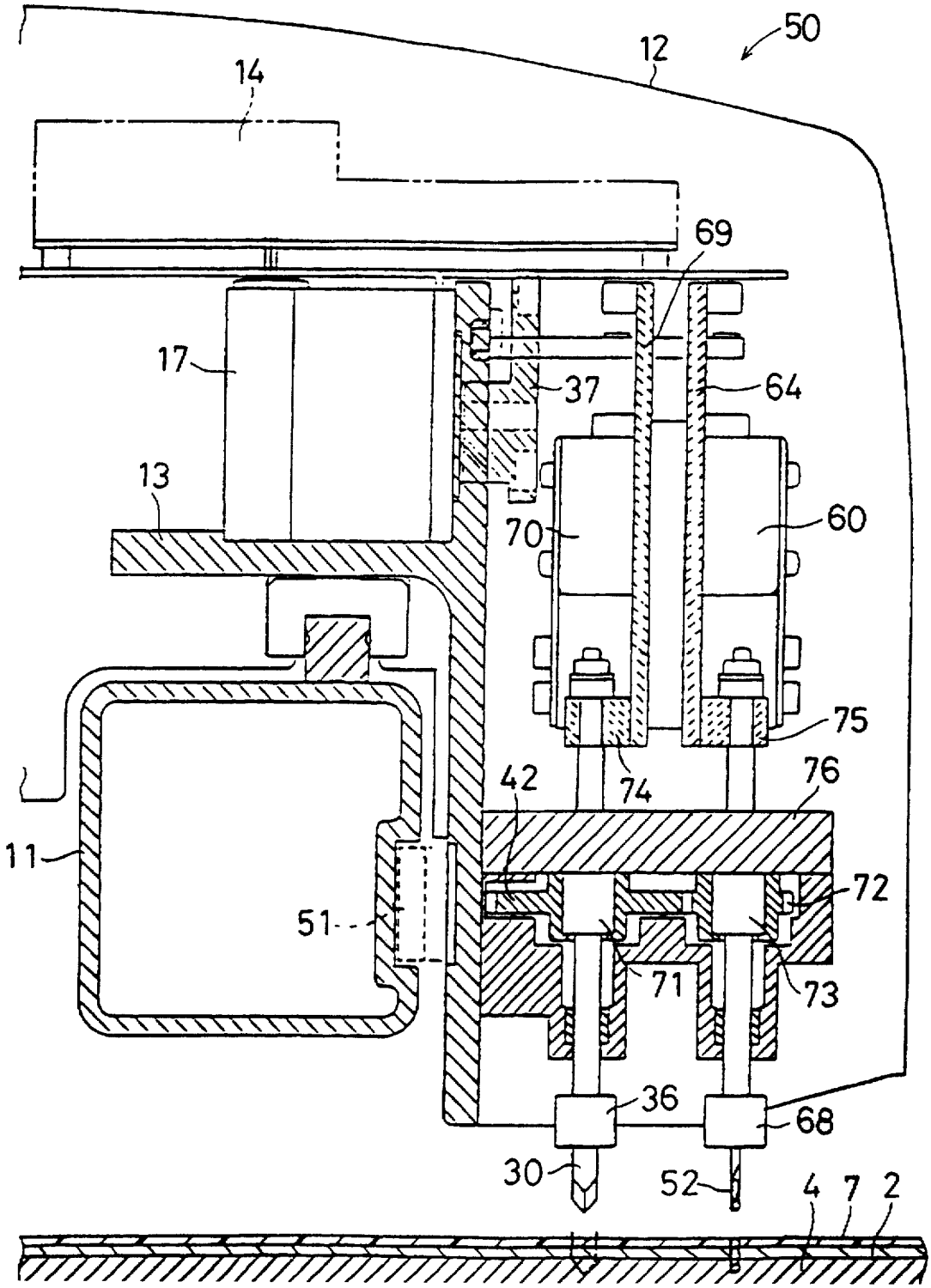
FIG. 3 is a sectional view on the left side of FIG. 2.
Figure 4:
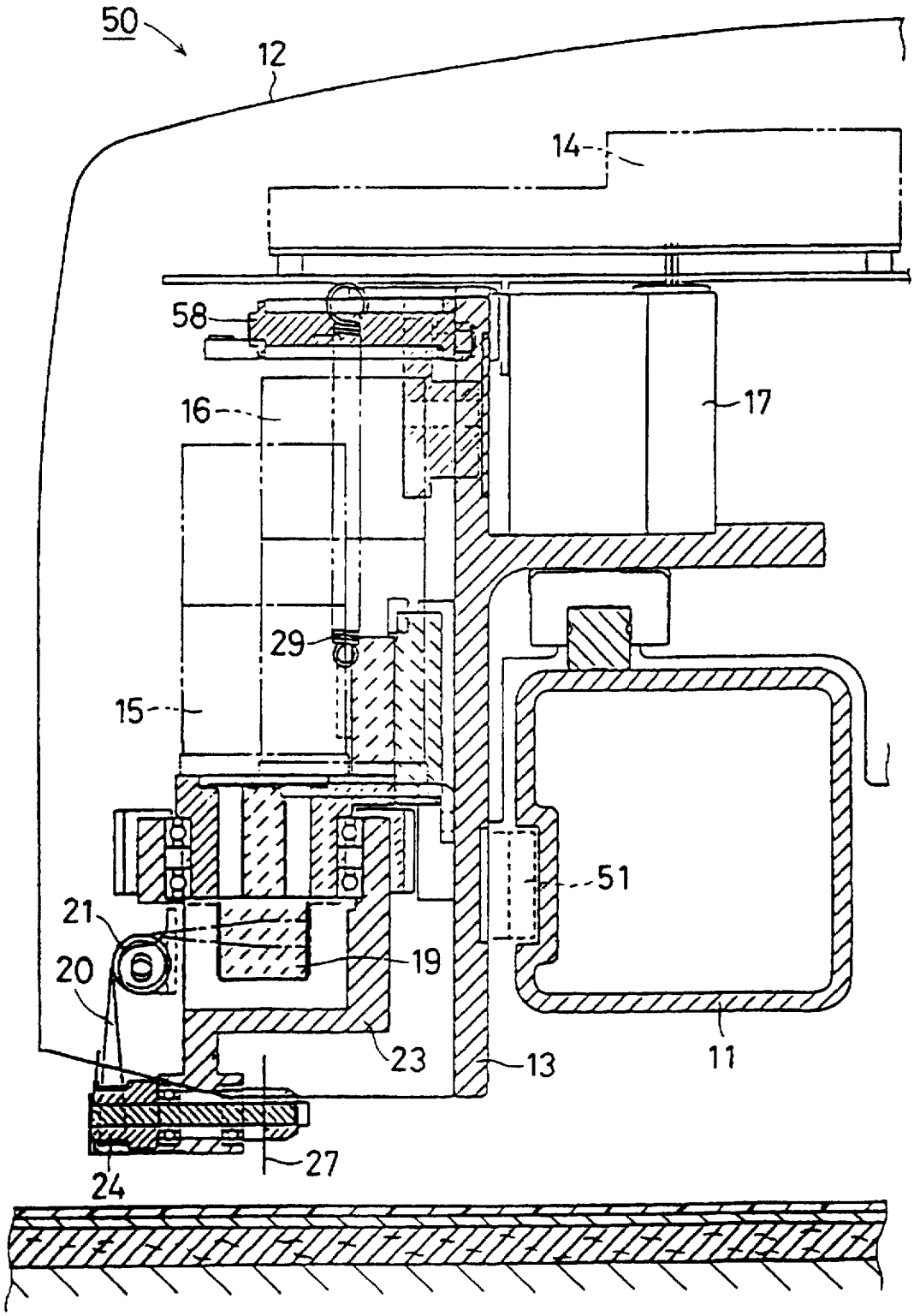
FIG. 4 is a sectional view on the right side of FIG. 2.
Figure 5:
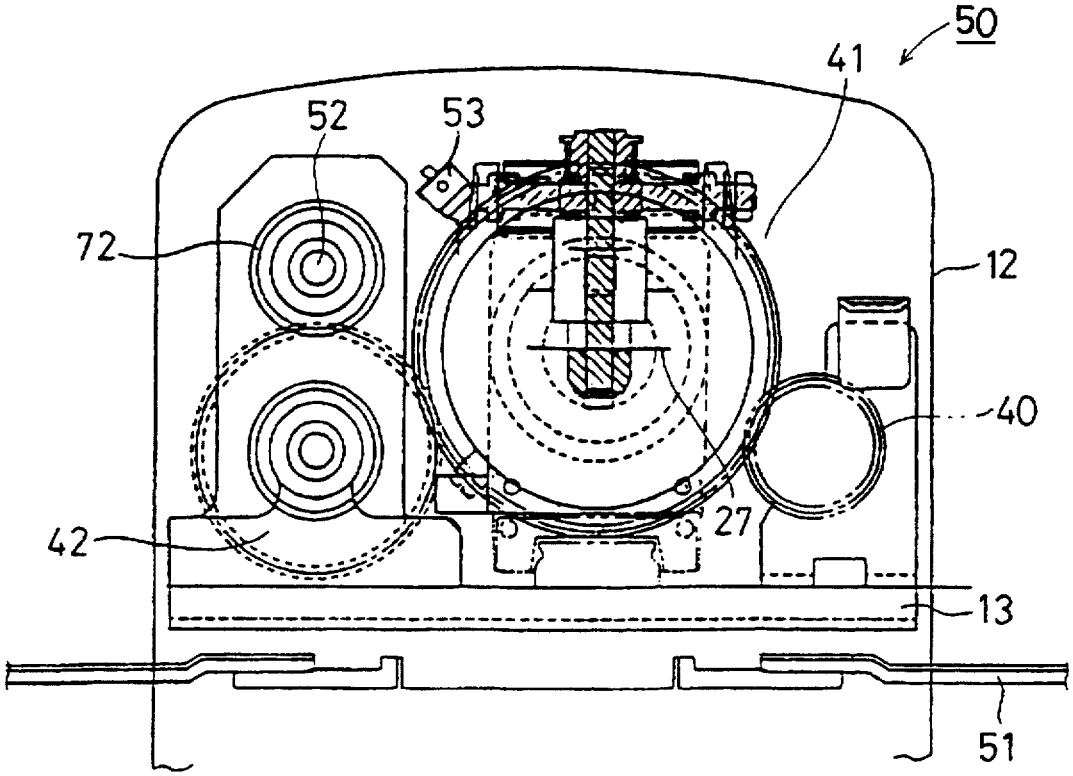
FIG. 5 is a sectional view on the bottom of FIG. 2.

FIG. 2 through FIG. 5 show the configuration of a cutting head 50 of a cutting machine according to another embodiment of the invention. FIG. 2 shows a front sectional view, FIG. 3 shows a sectional view on the left side, FIG. 4 shows a sectional view on the right side, and FIG. 5 shows a sectional plan view. Portions of this embodiment similar to corresponding portions of the embodiment shown in FIG. 1 are identified with identical numerals and description thereof will be omitted.

The cutting head 50 is also capable of drilling in the sheet material 2 by penetrating therethrough with a perforating drill 52 housed in the housing 12 which is pulled by a drive belt 51 to move along the beam 11 in Y-axis direction. In order to see whether the round blade 27 is oriented in the reference direction or not, a home position sensor 53 is installed. The home position sensor 53 directly detects the orientation of the round blade 27. Orientation of the notching blade 30 can be easily determined by converting from the gear ratio of the driven gear 41 for the round blade and the driven gear 42 for the notching blade.

Linked via a pin 54 to the holder 18 is a vertical motion lever 55. Pivotally supported at the tip of the vertical motion lever 55 is a follower 56 which is engaged in a cam groove 57 formed in a round blade cam 37. A notching blade cam 38 has a cam surface formed on the periphery thereof for oscillating a pull-up lever 58 about a shaft 59. When the pull-up lever 58 is pulled up by the notching blade cam 38, this state can be held by the solenoid 60. Tip of a plunger of the solenoid 60 makes contact with one end of a dogleg-shaped perforating drill holding lever 61. The perforating drill holding lever 61 is supported by a pin 62 at the center thereof to be capable of making angular displacement, with one end thereof being pressed by a spring 63 against the tip of the plunger of the solenoid 60 and another end being capable of holding a perforating drill pull-up lever 64 by pressing a notch 65 thereof. The perforating drill pull-up lever 64 is fitted with a pin 66 at the top end thereof for pulling up by means of the pull-up lever 58. A perforating drill pull-down lever 64 is pulled down by a perforating drill spring 67 which works as pressing means. The solenoid 60 is of self-holding type wherein pulsed current is fed to switch the perforating drill pull-up lever 64 between held and released states. The housing 12 has a bearing 68, through which the perforating drill 52 is passed, being mounted on the bottom surface thereof.

The configuration of pulling up the notching blade 30 and pressing it against the sheet material 2 is basically the same as the case of the perforating drill 52. Installed above the notching blade 30 is a notching blade pull-up lever 69 to be pulled up at the same as the perforating drill pull-up lever 64 by the pull-up lever 58. The notching blade pull-up lever 69 which has been pulled up is switched by the solenoid 70 between held and released states. A ball spline 71 is inserted at an upper portion of the notching blade 30. Mounted at an upper portion of the perforating drill 52 is a driven gear 72 for the perforating drill wherein a ball spline 73 is inserted. The ball splines 71, 73 permit displacement in the axial direction and suppress angular displacement about the axial line. Maximum amount of downward displacement in the axial line is limited by stoppers 74, 75 made of hard rubber mounted on the notching blade 30 and the perforating drill 52 at upper portions thereof, respectively, making contact with the surface of the support member 76. State of the round blade 27 being pulled up is detected by a proximity sensor 77. Home position of the round cutting blade 27 in Z-axis direction is detected by a home position sensor 78.

Installed between a shoulder portion of the holder 18 and the vertical motion lever 55 are a spring 80 and a bolt 81. In case there is a foreign matter on the cutting table 3 causing the round blade 27 to be moved upward, the spring 80 contracts to make the round blade 27 recede, and therefore impact can be absorbed. Depending on the cutting method, such a configuration may also be employed as the round cutting blade 27 is imparted with pressing force by the spring 80.

Figure 6:
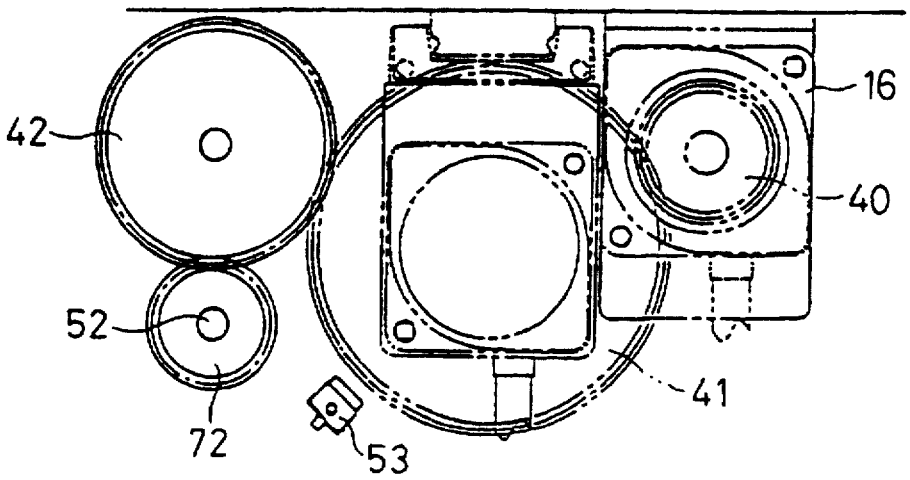
FIG. 6 is a partial plan view showing a driving force transmission mechanism of FIG. 2.

FIG. 6 shows a mechanism of transmitting driving force from an angular displacement motor 16 in the embodiment of FIG. 2. Driving force is transmitted from the drive gear 40 through the driven gear 41 for the round blade, the driven gear 42 for the notching blade and the driven gear 72 for the perforating drill, in this order. Reference position of the driven gear 41 for the round blade in angular displacement is detected by the home position sensor 53. Angular displacements required of the round blade 27 and the notching blade 30 are normally within 360 degrees. It is necessary to keep the perforating drill 52 always rotating during operation. At this time, intermediate gears must also be rotating. In order to reduce noise, the gears are preferably made of synthetic resin such as polyacetal and nylon.

Figure 7:
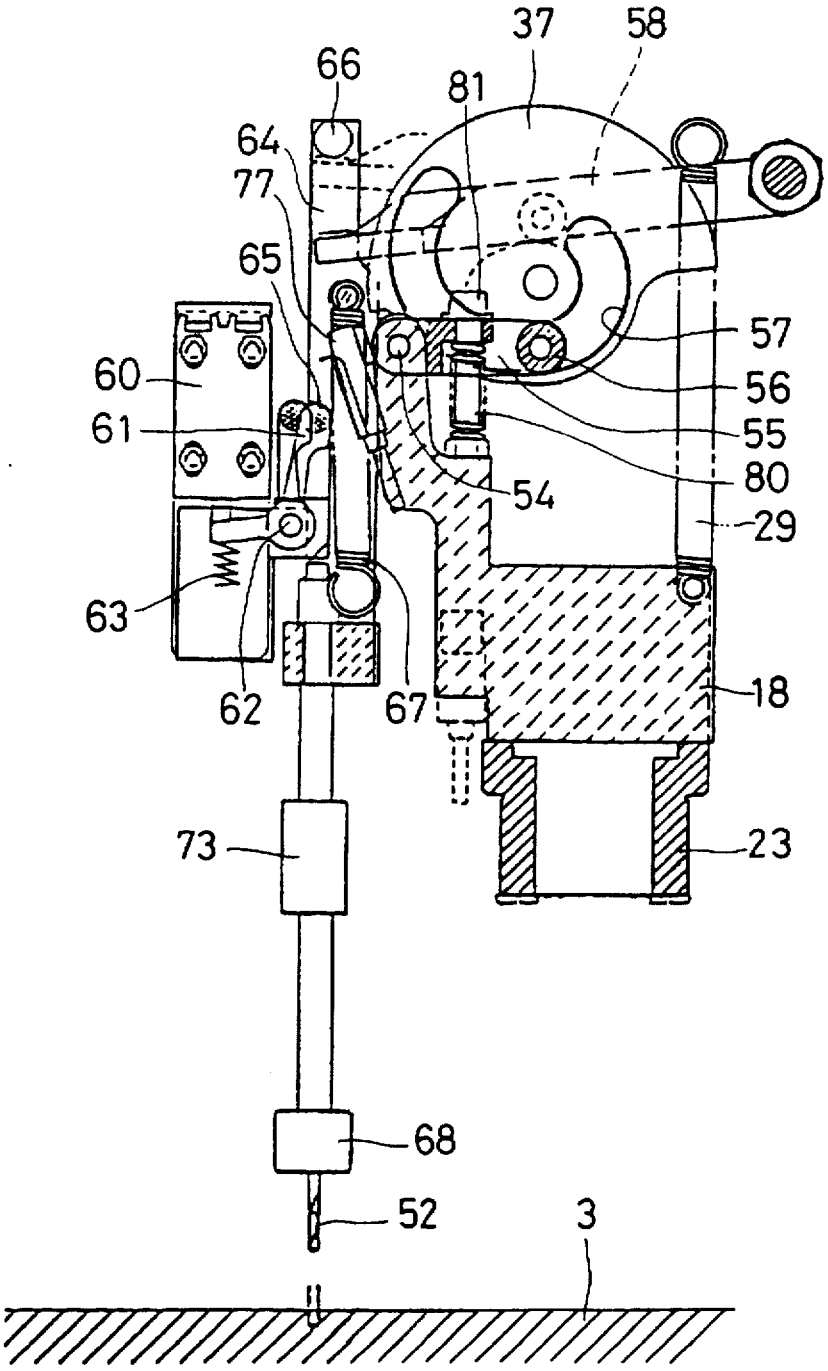
FIG. 7 is a partial front sectional view showing a cam mechanism of FIG. 2.
Figure 8:
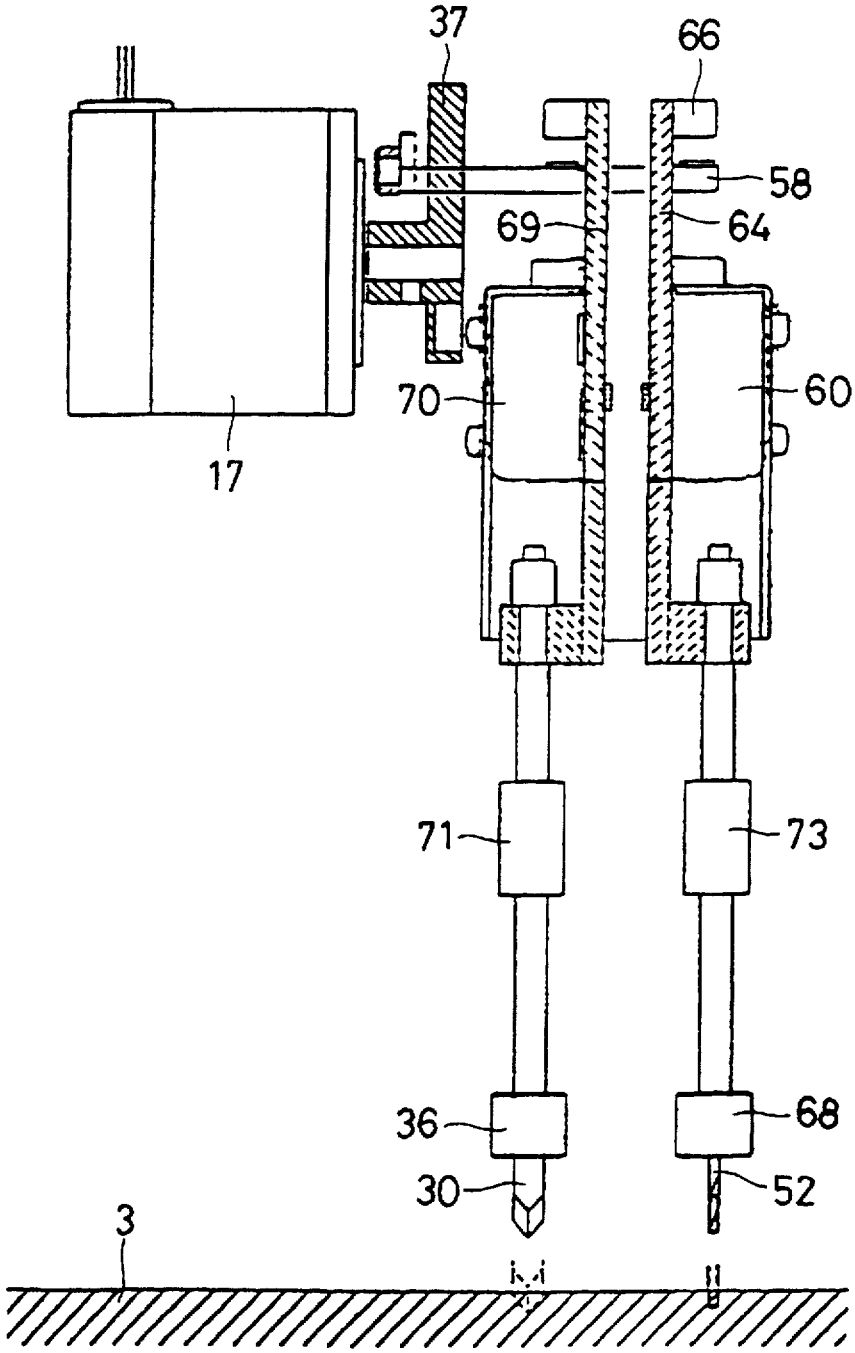
FIG. 8 is a partial sectional view on the left side showing the cam mechanism of FIG. 2.
Figure 9:
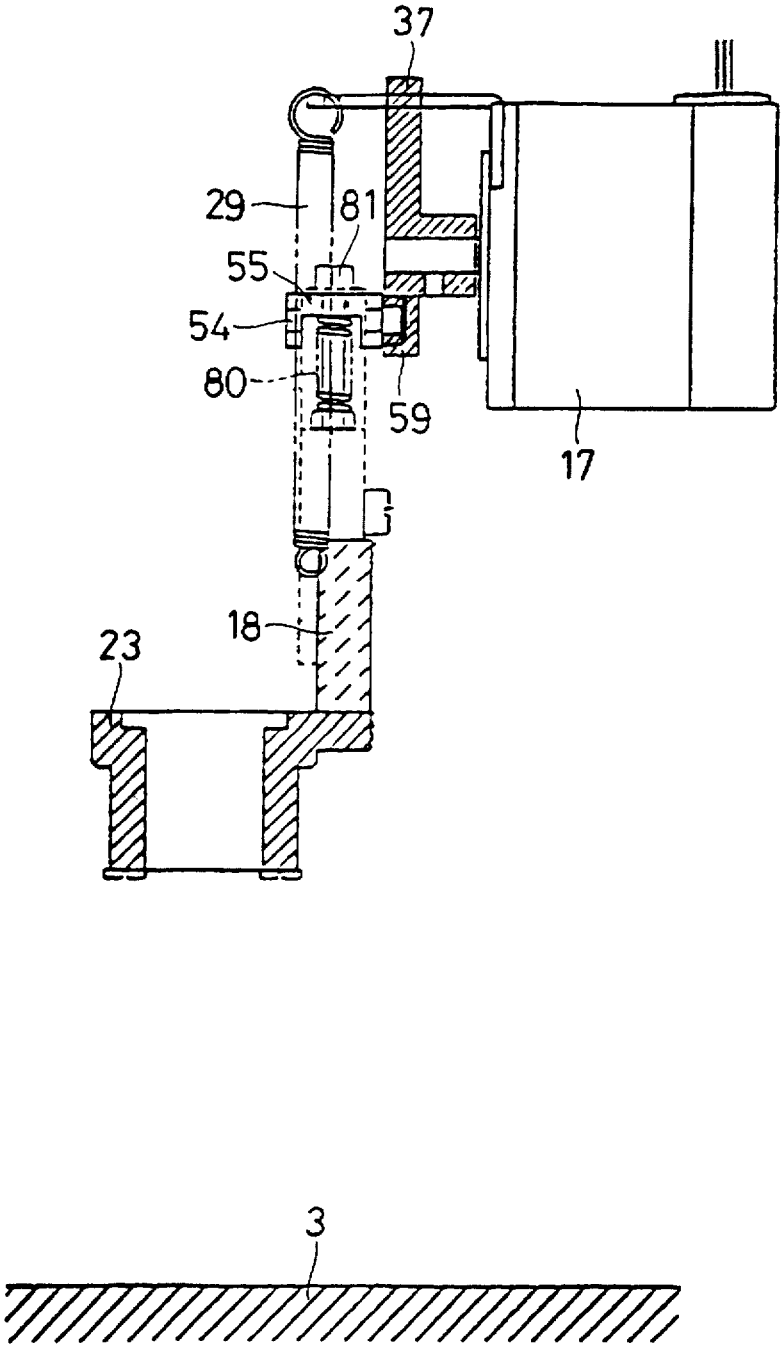
FIG. 9 is a partial sectional view on the right side showing the cam mechanism of FIG. 2.
Figure 10:
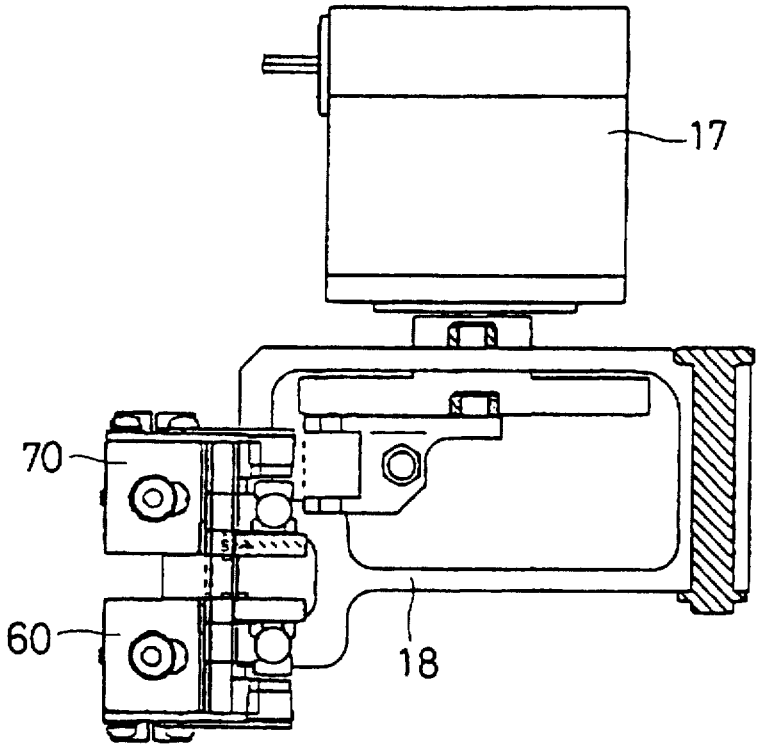
FIG. 10 is a partial sectional plan view showing the cam mechanism of FIG. 2.

FIG. 7 through FIG. 10 show the configuration of the cam mechanism working as selecting means in the embodiment of FIG. 2. In the description that follows, the sheet material placed on the cutting table 3 and the like are omitted from the drawing. FIG. 7 is a front sectional view, FIG. 8 is a sectional view on the left side, FIG. 9 is a sectional view on the right side and FIG. 10 sectional plan view, all drawn schematically. The holder 18 is shown being pulled up with tip of the pull-up lever 58 having come down by the gravity. In case the solenoids 60, 70 are actuated to release the perforating drill pull-up lever 64 or the notching blade pull-up lever 69 from the holding state, the perforating drill 52 or the notching blade 30 is ejected by the spring in piercing manner toward the cutting table 3.

Figure 11A:
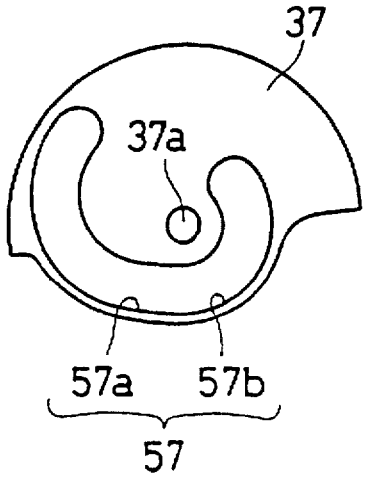
FIG. 11A is a front view of the cam mechanism of FIG. 2.
Figure 11B:
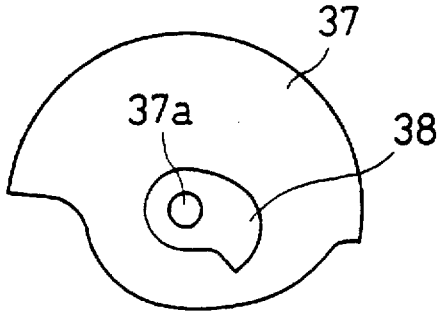
FIG. 11B is a rear view of the cam mechanism of FIG. 2.

FIG. 11A and FIG. 11B show the relationship between the round blade cam 37 and the notching blade cam 38 of FIG. 2. The cam groove 57 on the front side of the round blade cam 37 shown in FIG. 11(A) has a portion 57*a* for moving the round blade vertically where the radius from the central axis 37 changes and a straight portion 57*b* having a constant radius. When the follower 56 shown in FIG. 7 is engaged in the straight portion 57*b*, the mechanism is put in phase so that radius from the central axis 37*a* to a portion, where a cam surface formed on the periphery of the notching blade cam 38 on the back side of the round blade cam 37 shown in FIG. 11(B) makes contact with the pull-up lever 58 shown in FIG. 7, changes. That is, recess and projection of the notching blade cam 38 are made to correspond with the portion 57*a* for moving the round blade vertically and the straight portion 57*b* of the round blade cam 37.

Figure 12:
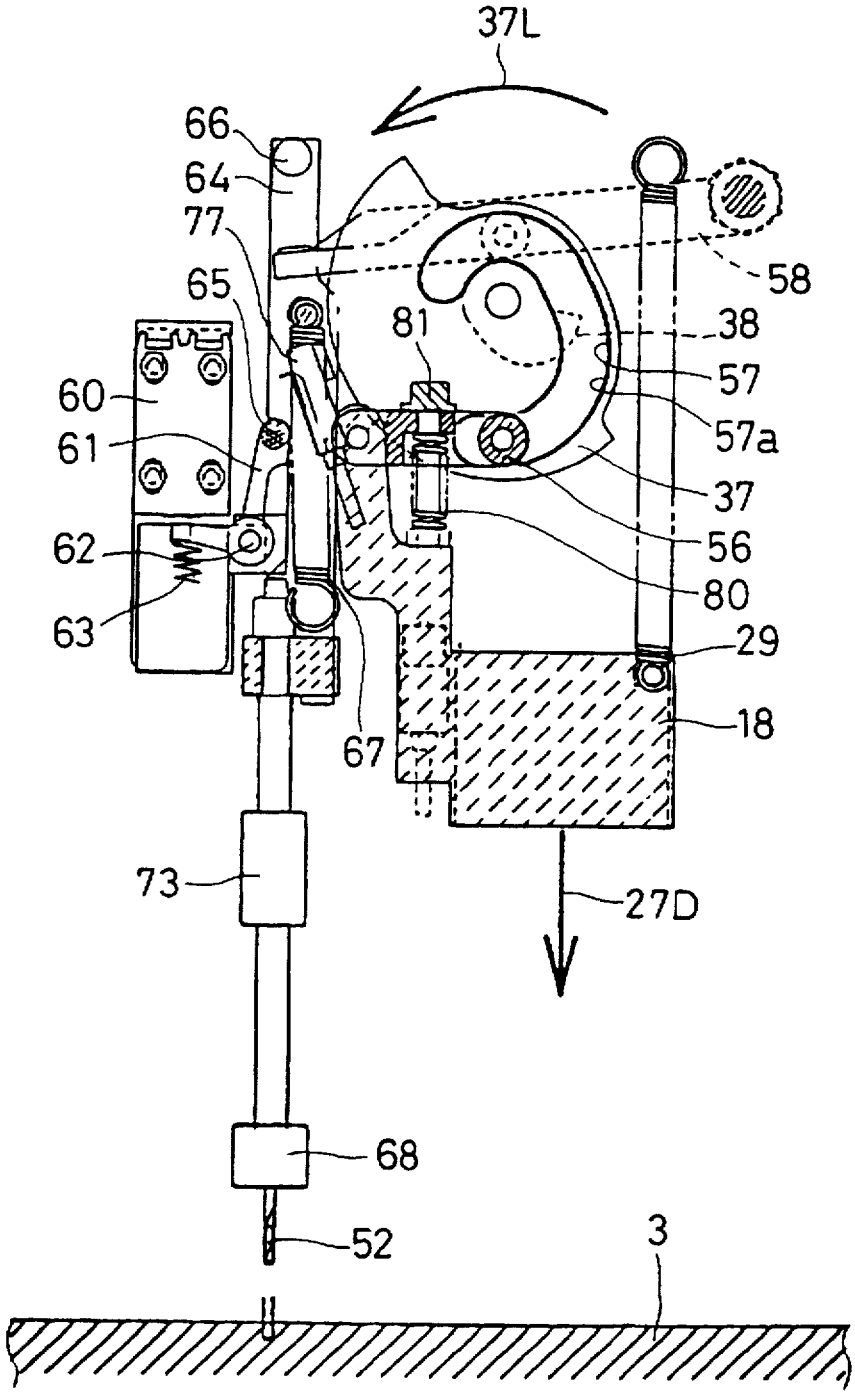
FIG. 12 is a front sectional view of the cam mechanism of FIG. 2 for showing a state where a round blade is lowered.
Figure 13:
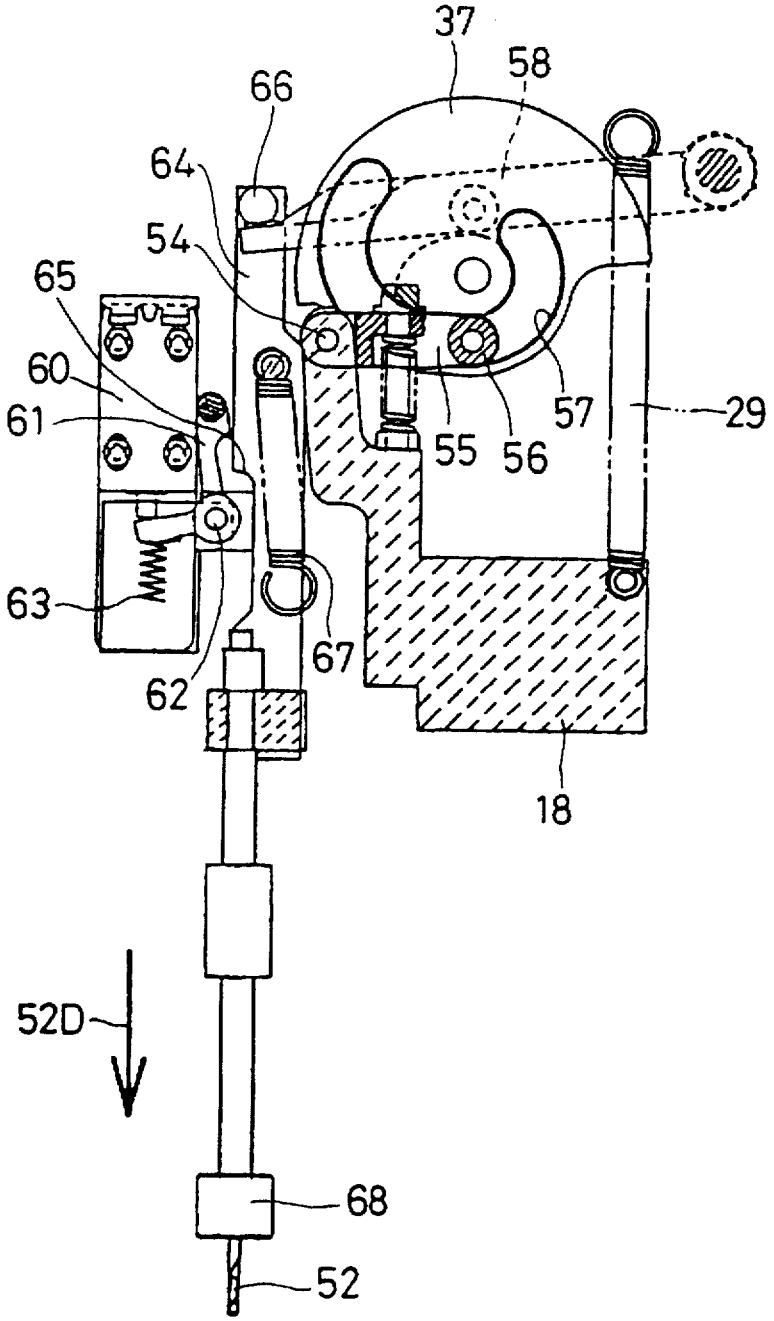
FIG. 13 is a front sectional view of the cam mechanism of FIG. 2 for showing a state where a notching blade and a perforating drill are lowered.
Figure 14:
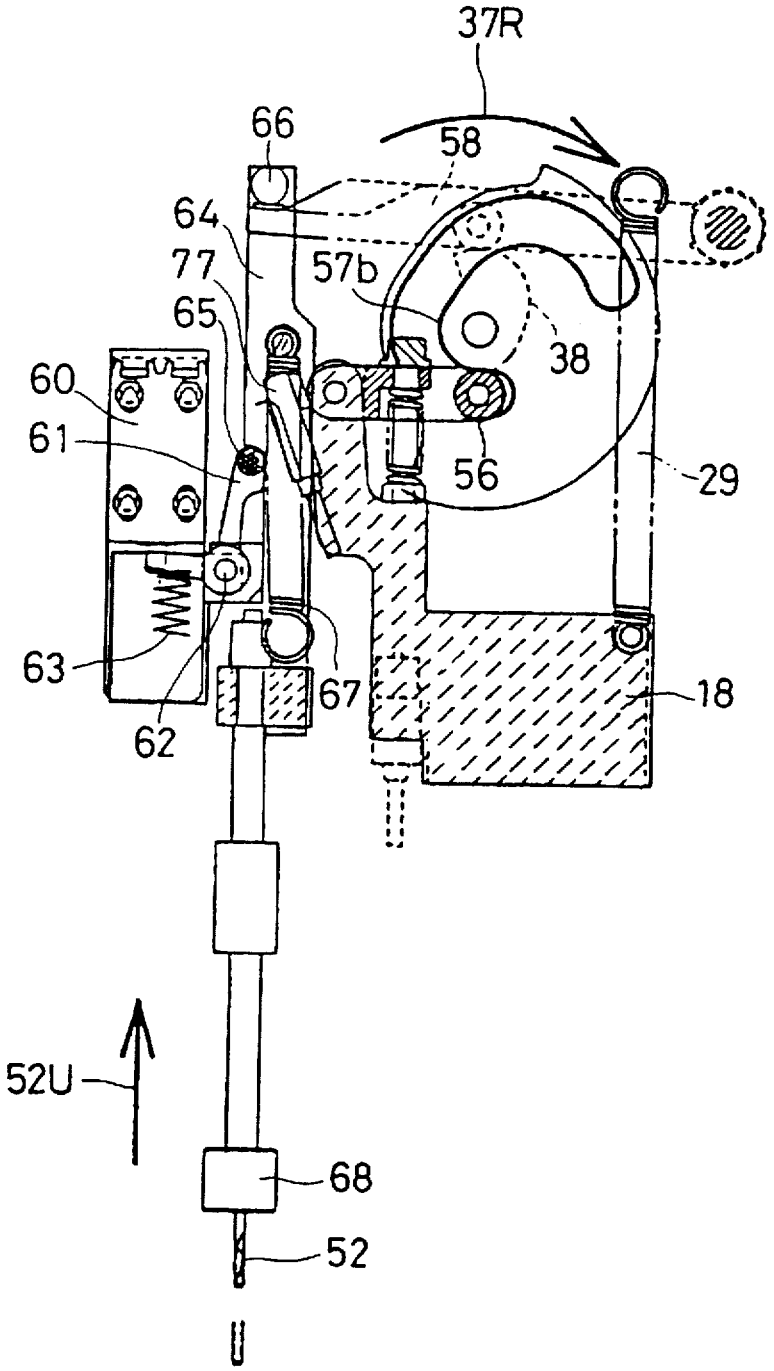
FIG. 14 is a front sectional view of the cam mechanism of FIG. 2 for showing a state where the notching blade and the perforating drill are raised.

FIG. 12, FIG. 13 and FIG. 14 show the relation between the angular displacement and vertical displacement of the round blade cam 37. FIG. 12 shows the follower 56 being engaged in the portion 57*a* for moving the round blade vertically of the cam groove 57 causing the round blade cam 37 to make angular displacement in the 37L direction so that the holder 18 comes down with the round blade coming down in the 27D direction. FIG. 13 shows the holder 18 moving upward with the follower 56 being engaged around mid point of the cam groove 57, the perforating drill holding lever 61 releasing the notch 65 of the perforating drill pull-up lever 64, causing the perforating drill 52 to move down in the direction of 52D. FIG. 14 shows the round blade cam 37 making angular displacement in 37R direction so that the follower 56 engages with the straight portion 57*b* of the cam groove 57, pulls up the pull-up lever 58 to lift the pin 66 thus causing the perforating drill 52 to move upward in 52U direction. The notching blade 27 is also caused to make vertical displacement similarly.

Figure 15A:
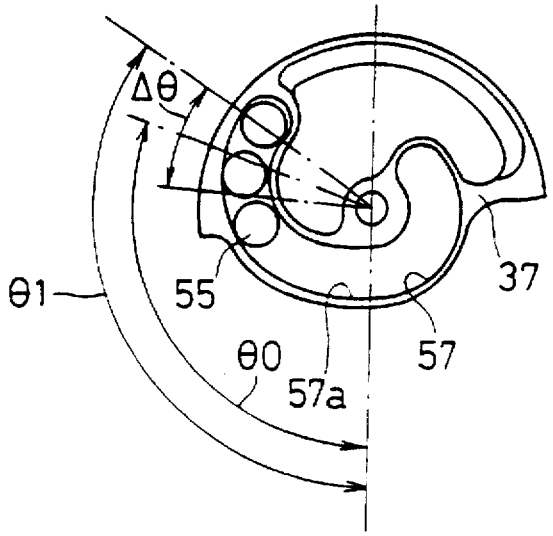
FIG. 15A is a front view of a round blade cam 37 of still another embodiment of the invention.
Figure 15B:
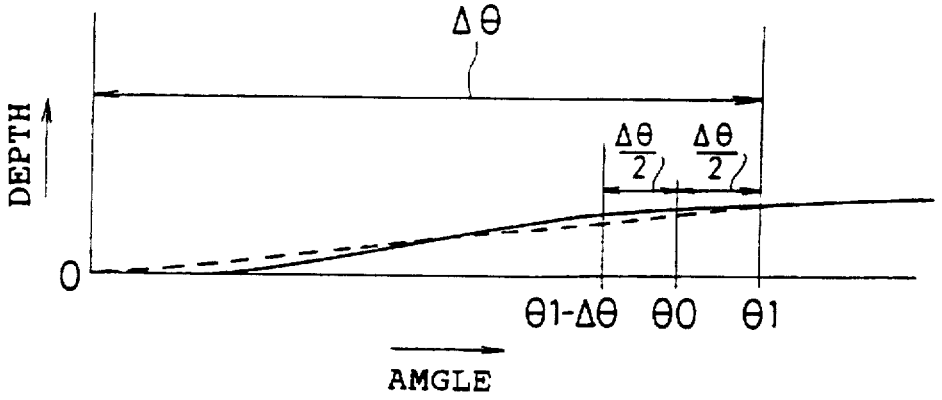
FIG. 15B is a graph showing the relationship between angles of a round blade cam 37 and penetrating depths of a round blade 27.

FIGS. 15A and 15B show a configuration for compensating for wear of the round blade 27 due to grinding by means of the cam groove 57 of the round blade cam 37 according to still another embodiment of the invention. As shown in FIG. 15A, the portion 57*a* for vertically moving the round blade of the cam groove 57 is distributed over a range to angle θ 1 and has such a slight inclination indicated by solid line that causes displacement of the round blade 27 in Z-axis direction in a range of =Δθ around angle θ at the center as shown in FIG. 15B. That is, if the cam groove is used for vertically moving the round blade, over the total range from angle 0 to angle θ 1, the variation becomes linear as indicated by broken line in FIG. 15 B. The variation indicated by solid line is steep in a range between angle 0 and angle θ 1, and is utilized for vertically moving the round blade 27. In the embodiment shown in FIG. 1, for example, the round blade 27 is ground by means of the grinding stone 44, and according to the amount of wear of the blade, the angle of the cam 37 for the round blade is set within a range of angle θ 0=Δ θ , and the position of the round blade 27 in Z-axis direction is corrected. The amount of wear is determined by either estimating from the duration of grinding or direct measurement. By making it possible to correct the position of the round blade 27 in Z-axis direction in such a manner, the position of the round blade 27 can be effectively adjusted and accordingly the problem of wear of surfaces of the base sheet 4, the cutting table 3, etc. is solved.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A cutting machine which has a cutting table; a round blade for cutting a sheet material spread on a surface of the cutting table with a circumferential cutting edge thereof, the round blade having a rotation shaft parallel to the surface of the cutting table; and a cutting head for cutting the sheet material, while moving in parallel with the surface of the cutting table according to cutting data, the cutting head having a notching blade for cutting the sheet material by pressing an edge thereof against an surface of the sheet material, the cutting machine comprising:

selecting means for selectively displacing either the round blade or the notching blade in a direction of approaching or departing from the cutting table by driving force from a common drive source, and thereby selectively applying either the round blade or the notching blade to the sheet material to cut it;

an angular displacement motor for driving the round blade and the notching blade so that a cutting direction is changed by angular displacement about an angular displacement axis thereof perpendicular to the surface of the cutting table;

transmitting means for transmitting driving force from the angular displacement motor to angular displacement shafts of the round blade and the notching blade in a predetermined proportion; and control means for controlling the angular displacement motor so that the cutting direction of the round blade or the notching blade changes according to the cutting data.

2. The cutting machine of claim 1, wherein the transmitting means has driven gears mounted on the respective angular displacement shafts and a drive gear which is mounted on a rotation shaft of the angular displacement motor and is meshed with the respective driven gears, and at least either of the drive gear and the driven gears have a thickness in the axis direction so that the gears can be kept in mesh even when the driven gears are displaced in a direction of approaching or departing from the cutting table.

3. The cutting machine of claim 1, wherein the cutting head further has a perforating drill for perforating the sheet material, which perforating drill has a rotation axis perpendicular to the cutting table and is driven by the driving force from the angular displacement motor to rotate, and the selecting means selects one from among the round blade, the notching blade and the perforating drill, and allows the selected one to work on the sheet material by displacement in a direction of approaching and departing from the cutting table.

4. A cutting machine which has a cutting table, a round blade having a rotation shaft parallel to a surface of the cutting table for cutting sheet material spread on the surface of the cutting table with a circumferential edge thereof, a notching blade for cutting the sheet material by pressing an edge thereof against the sheet surface and a cutting head for cutting the sheet material while moving in parallel with the surface of the cutting table according to cutting data, the cutting machine comprising:

supporting means for supporting the round blade so as to rotate about the rotation axis thereof, be angularly displaced about an angular displacement axis perpendicular to the cutting table surface and be reciprocatingly displaced along the angular displacement axis;

round blade cam means for driving the supporting means to be displaced in a direction of approaching or departing from the cutting table;

a cam motor for driving the round blade cam means;

notching blade cam means driven by the cam motor, for driving the notching blade to be displaced in a direction of departing from the cutting table when the round blade is moved by the round blade cam means beyond a predetermined amount of displacement in the direction of departing from the cutting table;

notching blade pressing means for pressing the notching blade in a direction of approaching the cutting table;

notching blade holding means for holding the notching blade in a state of being departed from the cutting table; and control means for controlling the cam motor and the notching blade holding means so that either the round blade or the notching blade works on the sheet material.

5. The cutting machine of claim 4, wherein the cutting head further has:

a perforating drill for perforating the sheet material by pressing against the cutting table;

perforating drill pressing means for pressing the perforating drill in a direction of approaching the cutting table; and perforating drill holding means for holding the perforating drill in a state of being departed from the cutting table, the notching blade cam means drives also the perforating drill to depart from the cutting table when the notching blade cam means drives the notching blade to be displaced in a direction of departing from the cutting table, and the control means controls the cam motor, the notching blade holding means and the perforating drill holding means so that one from among the round blade, the notching blade and the perforating drill is selected, and is displaced in a direction of approaching or departing from the cutting table to work on the sheet material.

6. The cutting machine of claim 4, wherein the round blade cam means has a vertical displacement portion for displacing the supporting means in a direction of approaching the cutting table, and a correction portion which displaces the supporting means within a range of a smaller amount of displacement than that of the vertical displacement portion, as a range of the displacement drive by the cam motor.

7. The cutting machine of claim 6, further comprising polishing means for polishing the round blade.

8. The cutting machine of claim 4, the cutting machine further comprising balancing means for causing reverse force to act against the gravity acting on the supporting means.

9. A cutting machine which has a cutting table, a round blade having a rotation shaft parallel to a surface of the cutting table for cutting sheet material spread on the surface of the cutting table with a circumferential edge thereof, a notching blade for cutting the sheet material by pressing an edge thereof against the sheet surface and a cutting head for cutting the sheet material while moving in parallel with the surface of the cutting table according to cutting data, the cutting machine comprising:

supporting means for supporting the round blade so as to rotate about the rotation axis thereof, be angularly displaced about an angular displacement axis perpendicular to the cutting table surface and be reciprocatingly displaced along the angular displacement axis;

round blade cam means for driving the supporting means to be displaced in a direction of approaching or departing from the cutting table;

a cam motor for driving the round blade cam means;

notching blade cam means driven by the cam motor, for driving the notching blade to be displaced in a direction of departing from the cutting table when the round blade is moved by the round blade cam means beyond a predetermined amount of displacement in the direction of departing from the cutting table;

notching blade pressing means for pressing the notching blade in a direction of approaching the cutting table;

notching blade holding means for holding the notching blade in a state of being departed from the cutting table;

an angular displacement motor for driving the round blade and the notching blade to be angularly displaced about the respective angular displacement axes thereof disposed perpendicular to the surface of the cutting table to change the cutting direction;

transmission means for transmitting the driving force from the angular displacement motor to the angular displacement shafts of the round blade and the notching blade in a predetermined proportion; and control means for controlling the cam motor and the notching blade holding means so that either the round blade or the notching blade works on the sheet material and for controlling the angular displacement motor to change the cutting direction of the round blade or the notching blade according to the cutting data.

* * * * *